US007925193B2

(12) United States Patent
Oomori et al.

(10) Patent No.: US 7,925,193 B2
(45) Date of Patent: Apr. 12, 2011

(54) ROTARY MEMBER, DEVELOPING DEVICE, AND IMAGE FORMING APPARATUS

(75) Inventors: Kouichi Oomori, Ibaraki (JP); Katsumasa Mikami, Ibaraki (JP); Katsumi Kumada, Osaka (JP); Yuichiro Suzuki, Ibaraki (JP); Minoru Toyoda, Osaka (JP); Yoshitaka Omori, Ibaraki (JP)

(73) Assignee: Ricoh Company, Ltd., Ohta-ku, Tokyo (JP)

( * ) Notice: Subject to any disclaimer, the term of this patent is extended or adjusted under 35 U.S.C. 154(b) by 92 days.

(21) Appl. No.: 12/232,301

(22) Filed: Sep. 15, 2008

(65) Prior Publication Data

US 2009/0074474 A1 Mar. 19, 2009

(30) Foreign Application Priority Data

Sep. 19, 2007 (JP) ..... P2007-242349

(51) Int. Cl.
*G03G 15/08* (2006.01)

(52) U.S. Cl. ..... 399/279; 399/286; 384/280; 384/276

(58) Field of Classification Search ..... 399/279, 399/286; 384/280, 276
See application file for complete search history.

(56) References Cited

U.S. PATENT DOCUMENTS

| | | | | |
|---|---|---|---|---|
| 2,778,066 | A * | 1/1957 | Walmsley | 384/280 |
| 2,821,010 | A * | 1/1958 | Vasconi et al. | 29/898.059 |
| 5,435,650 | A * | 7/1995 | Emig et al. | 384/29 |
| 5,697,029 | A * | 12/1997 | Saitoh et al. | 399/286 |
| 5,798,155 | A * | 8/1998 | Yanagawa et al. | 428/35.8 |
| 6,412,175 | B2 * | 7/2002 | Labombard | 29/895.22 |
| 7,099,613 | B2 * | 8/2006 | Nakamura et al. | 399/286 |

FOREIGN PATENT DOCUMENTS

| | | | |
|---|---|---|---|
| JP | 57-158867 | | 9/1982 |
| JP | 57167512 | A * | 10/1982 |
| JP | 60184443 | A * | 9/1985 |
| JP | 62-292918 | | 12/1987 |
| JP | 2000-039764 | | 2/2000 |
| JP | 2002-055522 | | 2/2002 |

* cited by examiner

*Primary Examiner* — Constantine Hannaher
(74) *Attorney, Agent, or Firm* — McGinn IP Law Group, PLLC

(57) ABSTRACT

A rotary member includes a rotating main body, and support members that are formed to be supported by bearings. Each of the support members includes a spindle core formed of a first metal, and a cylindrical sheath that sheathes a portion of the spindle core where slidably contacting respective one of the bearings and that is formed of a second metal different from the first metal.

17 Claims, 3 Drawing Sheets

ROTARY MEMBER, DEVELOPING DEVICE, AND IMAGE FORMING APPARATUS

CROSS-REFERENCE TO RELATED APPLICATIONS

This application claims priority from Japanese Patent Application No. 2007-242349 filed on Sep. 19, 2007, the entire contents of which is incorporated herein by reference.

BACKGROUND OF THE INVENTION

1. Field of the Invention

An aspect of the present invention relates to a rotary member supported by bearings in a rotatable manner, and more particularly to a rotary member that imparts toner to a photosensitive element while remaining in rotational contact with the photosensitive element and to a developing device and an image forming apparatus using the rotary member.

2. Description of the Related Art

Conventionally, in an image forming apparatus, a developing roller corresponding to a rotary member is brought, while being rotated, into contact with a photosensitive element in order to create a toner image on the photosensitive element, thereby visualizing an electrostatic latent image on the photosensitive element. In order to rotate the developing roller, a drive member is disposed at least one end of the developing roller. Support members disposed at both ends of the developing roller are supported in a rotatable manner by a developing device by way of bearing members. Therefore, a reduction in abrasion of the support members disposed at both ends of the developing roller induced by friction with the bearing members is sought.

Moreover, in order to create a toner image on the photosensitive element, a given voltage is applied to the developing roller, and a potential difference between the photosensitive element and the developing roller is utilized. Hence, it is also desired that the developing roller exhibits conductivity.

In order to satisfy the desire, JP-2002-55522-A describes; for example, a support member that uses stainless steel (SUS) for a core of a developing roller plated with nickel. In addition, using an aluminum alloy for a core and subjecting the core to electroless nickel plating are generally known.

However, the technique described in JP-2002-55522-A encounters problems; namely, an increase in the cost of a developing roller because stainless steel is expensive; the heavy weight of a developing device and that of an image forming apparatus because large specific gravity of the developing roller; and the cost incurred by countermeasures to prevent fall of the developing roller during a transport, or the like.

Moreover, when an aluminum alloy is used for the core of the developing roller, the core wears out by reason of friction with the bearing members of the developing device because of low hardness of aluminum. Therefore, as mentioned previously, the surface of the aluminum alloy is generally subjected to electroless nickel plating. However, since electroless nickel plating is expensive, there arises a problem of an increase in the cost of the developing roller.

SUMMARY OF THE INVENTION

According to an aspect of the present invention, there is provided a rotary member including: a rotating main body; and support members that are formed to be supported by bearings, wherein each of the support members includes: a spindle core formed of a first metal; and a cylindrical sheath that sheathes a portion of the spindle core where slidably contacting respective one of the bearings and that is formed of a second metal different from the first metal.

According to another aspect of the present invention, there is provided a developing device including the developing roller.

According to still another aspect of the present invention, there is provided an image forming apparatus including the developing device.

BRIEF DESCRIPTION OF THE DRAWINGS

Embodiments of the present invention will be described in detail based on the following figures, wherein.

DETAILED DESCRIPTION OF THE INVENTION

An embodiment of the present invention will be described hereunder by reference to the accompanying drawings.

Figure 1:
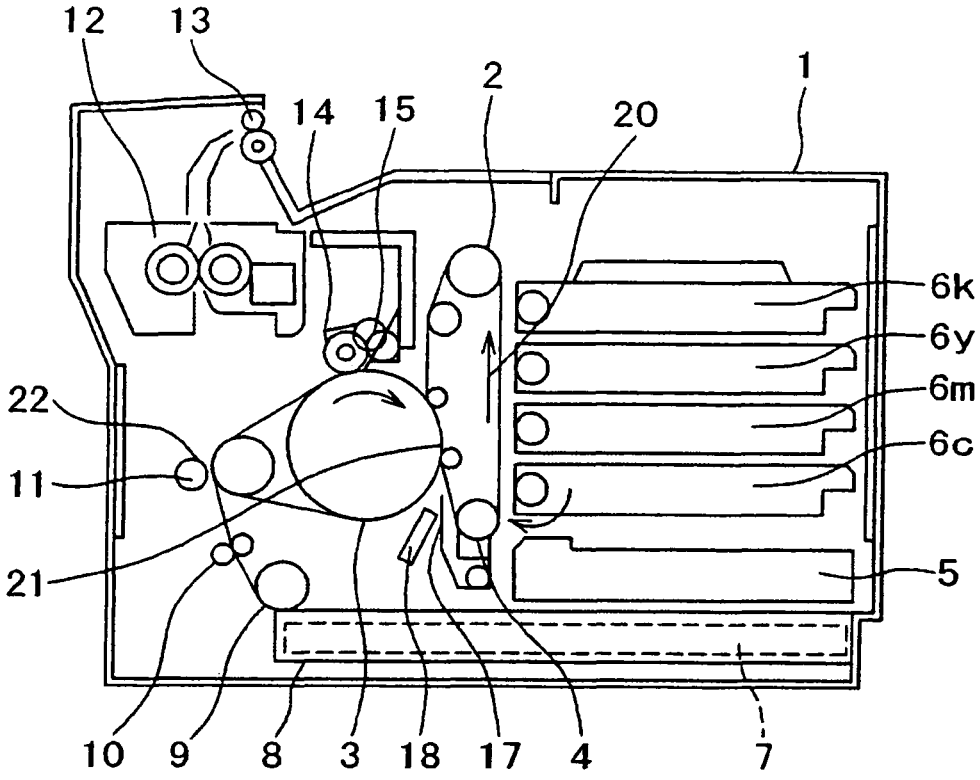
FIG. 1 is a general block diagram of an image forming apparatus according to an embodiment of the present invention.

FIG. 1 is a schematic view of an image forming apparatus serving as an embodiment of the present invention.

In an image forming apparatus 1, an endless photosensitive belt 2 serving as latent image holding element is disposed at the center of a machine case and arranged in the vertically-elongated circular shape. A transfer belt 3 serving as an intermediate transfer element, a transferring device 11, a recording medium 7, a sheet feeding device 9, and a fixing device 12 are arranged on the left side of the drawing with respect to the photosensitive belt 2. Developing devices 6*k*, 6*y*, 6*m*, and 6*c* filled with four different colors (black, yellow, magenta, and cyan) of nonmagnetic monocomponent toner (hereinafter called "toner") serving as colored fine powders are arranged on the right side of the drawing.

Further, an exposing device 5 for creating a latent image on the photosensitive belt 2 is arranged below the developing devices 6*k*, 6*y*, 6*m*, and 6*c*, and a sheet feeding cassette 8 that stores a recording medium 7 is disposed beneath the exposing device 5.

Moreover, the transferring device 11 and an intermediate-transfer-element cleaning device 14 are disposed around the transfer belt 3, and an electric charging device 4, a residual-image removing device 18, and a photosensitive-element cleaning device 17 are disposed around the photosensitive belt 2.

The photosensitive belt 2 is rotated in the direction of arrow 20 by a driving device (not shown) and a photosensitive layer on the surface of the photosensitive belt 2 is uniformly charged by the electric charging device 4. Next, in accordance with character information or image information, such as an image, created by a personal computer, an image scanner, or the like, the exposing device 5 exposes the photosensitive belt 2 on a per-dot basis, whereupon an electrostatic latent image is created on the surface of the photosensitive belt 2. The electrostatic latent image on the photosensitive belt 2 is developed by selected one of the developing devices 6*k*, 6*y*, 6*m*, and 6*c*, whereby toner images of selected colors are created. When development is not performed, the developing device 6 (the developing devices 6*k*, 6*y*, 6*m*, and 6*c*) is urged in a direction departing from the photosensitive belt 2 and receded to a position where fine particles, such as toner, can not move to the photosensitive belt 2.

The photosensitive belt 2 passed through a first transfer position 21 is exposed to uniform photoirradiation performed by the residual-image removing device 18, whereupon the electrostatic latent image is erased, and the surface potential of the belt drops to a admissible level or less. The remained toner on the surface of the photosensitive belt 2 as a result of not having been transferred through the previous transfer operation is removed by the photosensitive-element cleaning device 17, whereby the surface of the photosensitive belt 2 is cleaned, to thus prepare for creation of the next toner-image creation and transfer operation.

Operations for one cycle, such as creation and transfer of a toner image, are sequentially performed by respectively using the developing devices 6*k*, 6*y*, 6*m*, and 6*c* in synchronization with one rotation of the transfer belt 3, whereby a color toner image of a plurality of colors, in which respective monochrome toner images are superimposed one on top of the other, are created on the transfer belt 3.

The recording medium 7, such as a sheet and an OHP sheet, is synchronously fed from the sheet feeding device 9 and the sheet conveying device 10 to the second transfer position 22. At the second transfer position 22, a monochrome or color toner image created on the surface of the transfer belt 3 is transferred to the recording medium 7 by the transferring device 11.

The recording medium 7 on which the toner image is transferred is peeled off from the transfer belt 3, and the toner image is thermally fixed by the fixing device 12. The recording medium 7 is discharged by a sheet discharging device 13 to a sheet discharge tray located on the upper surface of the image forming apparatus 1.

Surplus toner still remaining on the surface of the transfer belt 3 after transfer of the toner image on the recording medium 7 is cleaned by the intermediate-transfer-element cleaning device 14 and recovered by a toner recovering device 15. The thus-cleaned transfer belt 3 prepares itself for transfer of the next toner image.

Figure 2:
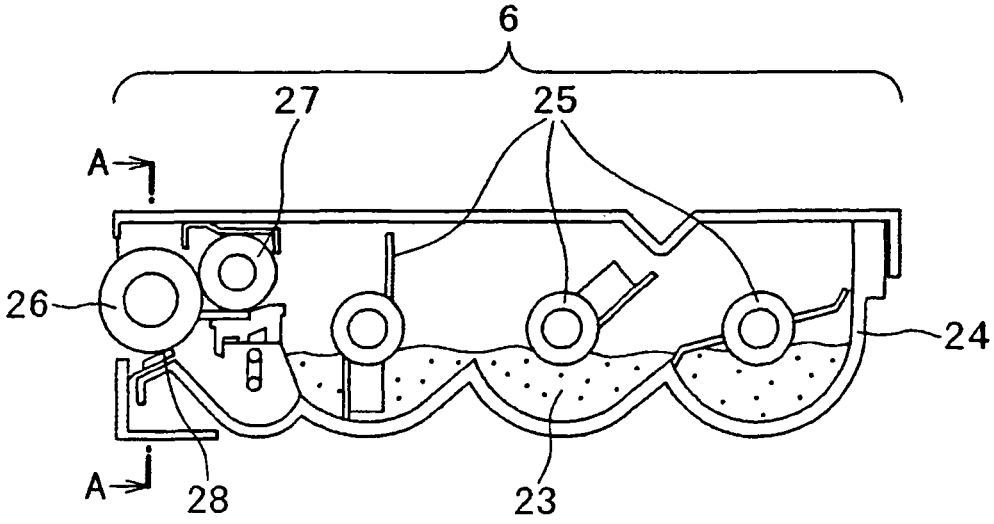
FIG. 2 is a cross-sectional view of a developing device according to the embodiment.
Figure 3:
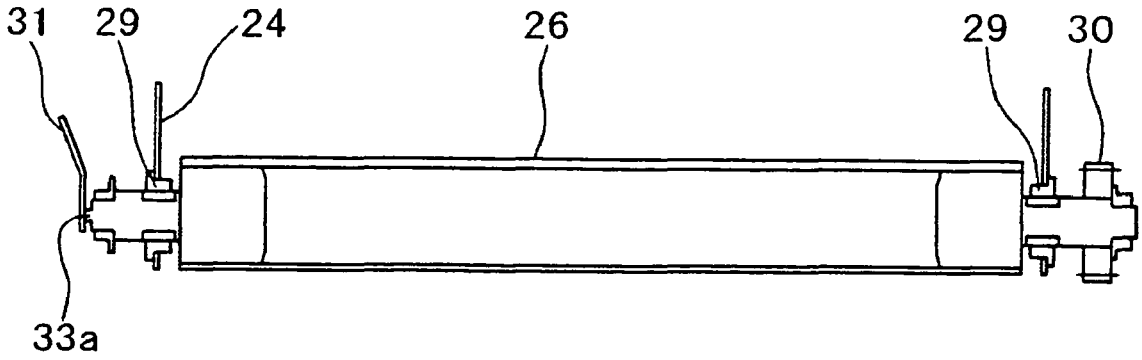
FIG. 3 is a cross-sectional view taken along line A-A' shown in FIG. 2.

FIG. 2 is a cross-sectional view of the developing device according to an embodiment of the present invention. FIG. 3 is a cross-sectional view taken along line A-A' shown in FIG. 2. The developing device 6 (the developing devices 6*k*, 6*y*, 6*m*, and 6*c*) is made up of a developing case 24 storing toner 23; a paddle 25 that stirs and conveys the toner 23 in the developing case 24; a feed roller 27 that supplies toner 23 from the developing case 24 to a developing roller 26; a blade 28 that is made of urethane rubber and that regulates the amount of toner fed onto the developing roller 26; bearings 29 that holds the developing roller 26 in the developing case 24; and a gear 30 that transmits a rotation force to the developing roller 26.

A voltage is applied to one end of the developing roller 26 through a leaf-spring electrode 31 located on a main unit of the apparatus. The voltage is applied from the developing roller 26 to the feed roller 27 by the bearings 29 and a feed electrode (not shown). Since the bearings 29 are required to have conductivity, the bearings 29 are made up of components formed by sintering iron and copper powder alloys.

First Embodiment

Figure 4:
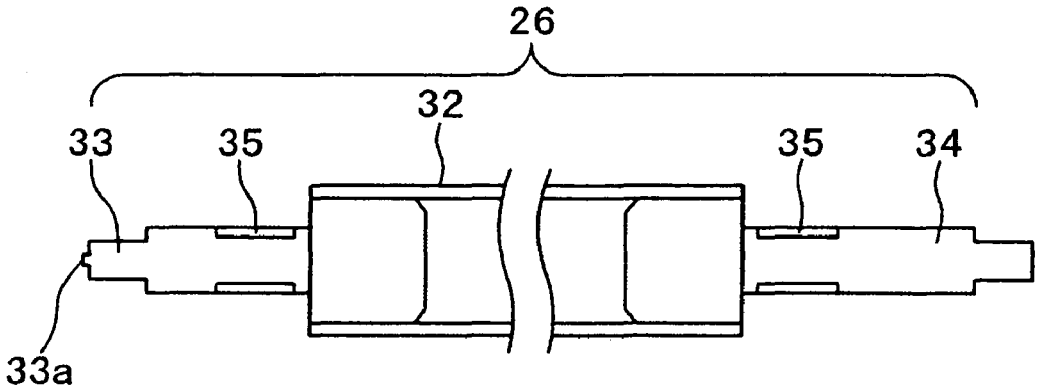
FIG. 4 is a cross-sectional view of a developing roller according to the embodiment.

FIG. 4 is a cross-sectional view of a developing roller according to an embodiment of the present invention. The developing roller 26 has a sleeve 32 formed into a cylindrical shape and formed of an aluminum alloy, and flanges 33 and 34 are press-fitted into both ends of the sleeve 32. The flanges 33 and 34 serve as spindle core elements. The sleeve 32 makes slidable contact with the blade 28, thereby imparting an electrostatic charge to the toner 23. To this end, the surface of the sleeve 32 is roughened to a given extent by the blasting. A material of the flanges 33 and 34 is the same aluminum alloy that used for the sleeve 32. The reason for this is to, since the flanges 33 and 34 are heated to a high temperature through the cleansing, or the like, after being press-fitted into the sleeve 32 in the manufacturing process, prevent removal of the flanges 33 and 34 caused by a difference in a thermal expansion between the sleeve 32 and the flanges 33 and 34.

A projection 33*a* that contacts the electrode 31 disposed on the main unit side of the image forming apparatus 1 is provided at the end of the flange 33. In view of abrasiveness, a material of the projection 33*a* must be more prone to wear than the material of the electrode 31. The reason for this is that the plurality of developing devices 6 is used in a replaceable fashion for a single image forming apparatus 1. In the present embodiment, a material of the electrode 31 is stainless steel, and a material of the projection 33*a* is aluminum alloy that is also used as the material of the flange 33.

Portions of the flanges 33 and 34 which slidably contact bearings 29 in a supported manner, in the longitudinal areas of the flanges 33 and 34, are sheathed with the flanges sleeves 35 having a cylindrical shape. As mentioned above, a "support member" signifies the flanges 33 and 34 partially sheathed with the respective flange sleeves 35 in an integrated fashion.

Figure 5A:
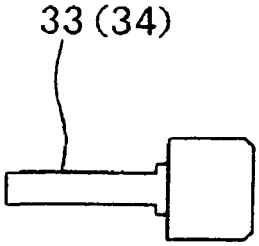
FIGS. 5A to 5C are views showing processes for manufacturing a supporting member according to a first embodiment of the present invention.
Figure 5B:
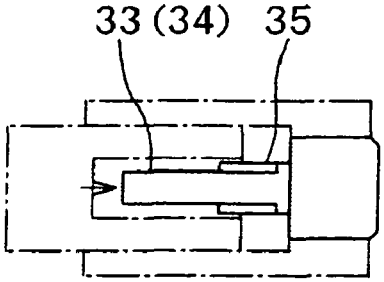
Figure 5C:
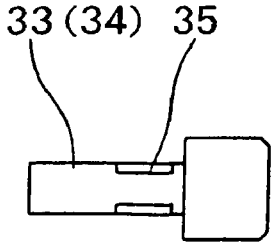

FIGS. 5A, 5B and 5C are views showing manufacturing processes of the support members according to the first embodiment. The flanges 33 and 34 are manufactured through forging processes. In a process shown in FIG. 5A, the flange 33 (34) is manufactured into a shape that is narrower than a given thickness. Next, in a process shown in FIG. 5B, the cylindrical-shaped flange sleeve 35 formed of stainless steel is inserted into the flange 33 (34) whose shape is narrower than the given thickness. A dashed line shown in FIG. 5B shows the outline of a forging mold. In a process shown in FIG. 5C, physical shock is imparted from the outside to the forging mold in a direction designated by an arrow in FIG. 5B, thereby forging the flange 33 (34) again. Thereby, the flange 33 (34) is crushed to fit the mold, whereby the shape of the flange 33 (34) is thickened. After the support member is manufactured, pressure is applied to an interior surface of the flange sleeve 35, whereby the flange sleeve 35 is firmly fastened to the flange 33 (34) to thus prevent idling of the flange sleeve 35. Thus, a support member in which the flange 33 (34) and the flange sleeve 35 are integrated together can be completed.

When compared with a developing roller made of a related-art support member formed by subjecting stainless steel to nickel plating or a support member formed by subjecting an aluminum alloy to electroless nickel plating, the developing roller can be manufactured inexpensively and simply.

Figure 6A:
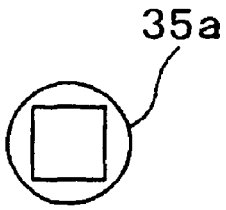
FIGS. 6A to 6C are views showing a flange sleeve (cylindrical member) according to another embodiment of the present invention.
Figure 6B:
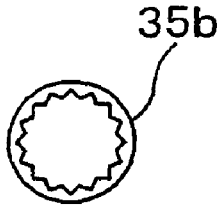
Figure 6C:
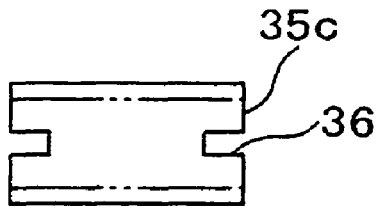

FIGS. 6A to 6C are views showing the flange sleeve according to another embodiment. In order to prevent idling of the flange sleeves 35 in a more reliable manner, the flange sleeves 35 are previously machined. Flange sleeves 35*a*, 35*b* are shown in FIGS. 6A and 6B. The inner surfaces of the flange sleeves 35*a* and 35*b* are formed into a shape other than a circular shape. In the flange sleeve 35*c* shown in FIG. 6C, both ends are notched into cutouts 36, such as angular indentations. By providing the cutouts 36, the cutouts 36 are filled with the metal of the flanges through the forging. Hence, idling of the flange sleeve 35*c* can be surely prevented. The flange sleeves may have any shape other than shapes of the flange sleeves 35*a* and 35*b* shown in FIGS. 6A and 6B as long as the shape provides force that prevents idling of the flange sleeves. In a flange sleeve 35*c* shown in FIG. 6C, a cutout may also be formed in one end of the flange sleeve. Thus, bonding strength acting between the flange sleeves 35*a*, 35*b*, and 35*c* and the flanges 33 and 34 is increased, so that idling of the flange sleeves 35*a*, 35*b*, and 35*c* can be surely prevented.

In the developing roller of the embodiments, the support member is manufactured by forging. However, the support member may be manufactured by aluminum die-casting.

In the embodiment, the bearings 29 are formed by sintering the iron-copper powder alloy and have a Vickers hardness Hv of 50 or thereabouts. Therefore, in order to exhibit superior abrasion resistance with respect to the bearings 29, the areas of the flanges 33, 34 that slidably contact the bearings 29 require a Vickers hardness Hv of about 150 that is about three times the hardness of the bearings 29. Since an aluminum alloy possesses a Vickers hardness Hv of about 100, the flanges wear out early when formed solely from an aluminum alloy, which greatly influences the life of the developing device. In the developing roller of the embodiments, the flange sleeves 35 employed in the areas where the flanges 33, 34 slidably contact with the bearings 29 are made from stainless steel. The stainless steel has a high Vickers hardness Hv of 200, and hence the flange sleeves 35 have superior abrasion resistance with respect to the bearings 29.

Figure 7:
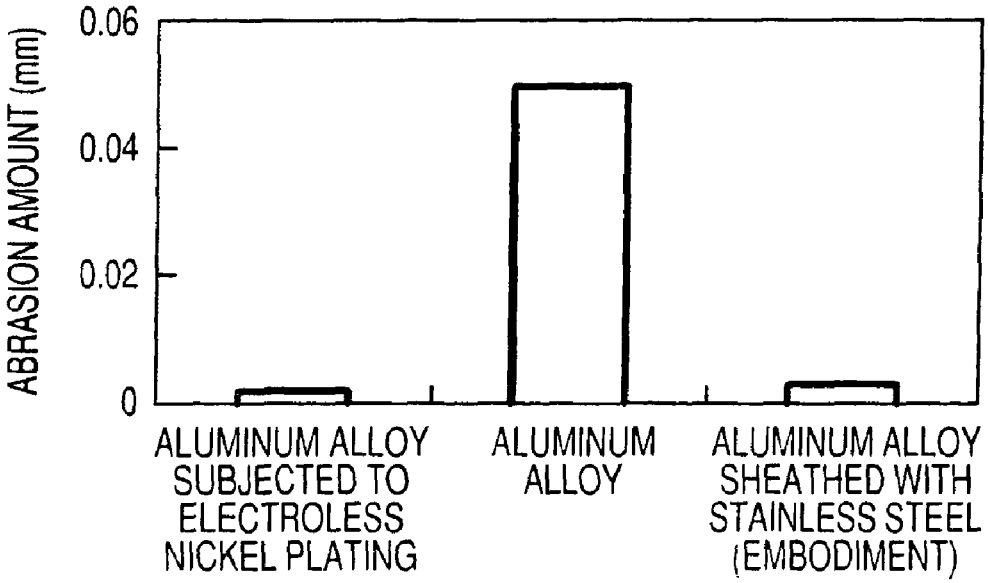
FIG. 7 is a view showing evaluation results of the support member of the first embodiment in terms of an abrasion characteristic.

FIG. 7 is a view showing evaluation results of the support members of the first embodiment in terms of an abrasion characteristic. In an evaluation test, there is evaluated an abrasion amount (mm) of metal in an area where metal slidably contacts, while rotating, a bearing in support members of three types of developing rollers. The three types include (1) a related-art support member formed of a aluminum alloy whose area to undergo slidable contact is subjected to electroless nickel plating; (2) a related-art support member formed only of a aluminum alloy; and (3) a support member according to the first embodiment in which the aluminum alloy is sheathed with a flange sleeve formed of stainless steel. Three types of developing rollers having these support members were incorporated into respective developing devices, and the rollers were operated at a standard rotational speed for operating hours that are ten times a standard operating hour of the developing device. Components that are formed by sintering an iron-copper powder alloy and that have a Vickers hardness Hv of about 50 are used for bearing members of the developing devices. As shown in FIG. 7, the support member according to the first embodiment in which the aluminum alloy is sheathed with the flange sleeve of stainless steel and the related-art support member formed by subjecting an aluminum alloy to electroless nickel plating exhibit the almost-same abrasion amount (mm) that is much smaller than the abrasion amount achieved by the related-art support member formed solely from the aluminum alloy having a Vickers hardness Hv of about 100. That is, the support member according to the first embodiment has superior abrasion resistance. Moreover, troubles caused by the abrasion did not arise in the developing devices. The abrasion amount (mm) represents a level difference (mm) between the area of the flange slidably contacting the bearing 29 and a non-slidably-contacting area by use of a surface roughness measuring device or an outer shape measuring device.

Since the developing roller 26 rotates while being supported by the bearings 29, temperatures of the flanges 33 and 34 and those of the flange sleeves 35 located in the areas of the developing roller 26 supported by the bearings 29 are increased by frictional heat developing during rotation. When the flange sleeves are not subjected to processing for preventing further idling of the flange sleeves, such as that shown in FIGS. 6A to 6C, a thermal expansion coefficient of the flanges 33 and 34 may be made greater than a thermal expansion coefficient of the flange sleeves 35 so as to ensure the fixing force between the flange sleeves 35 and the flanges 33 and 34. In the case of the first embodiment, an aluminum alloy that is a material of the flanges 33 and 34 has a thermal expansion coefficient of $23\times10^{-6}$/K, and stainless steel that is a material of the flange sleeves 35 has a thermal expansion coefficient of $17\times10^{-6}$/K. Since the flanges 33 and 34 are greater than the flange sleeves 35 in terms of a thermal expansion coefficient, a decrease in the fixing force of the flange sleeves 35, which would otherwise be caused by frictional heat, does not arise.

As mentioned above, in the support member of the developing roller 26 that rotates while being supported by the bearings 29, the flanges 33 and 34 formed from an aluminum alloy, which includes two types of dissimilar metals, are partially sheathed, by forging, with the flange sleeves 35 formed from stainless steel, whereby a developing roller having an inexpensive configuration, having superior abrasion resistance with respect to bearing members, and exhibiting stable conductivity can be implemented. Moreover, there is ensured adequate contact pressure between the developing roller and a photosensitive belt by use of the developing roller in a developing device and in an image forming apparatus, and hence provision of stable image quality and realization of high reliability can be attained. Further, the flanges 33 and 34 are formed from an aluminum alloy and hence lightweight. The cost incurred by transportation of developing devices and image forming apparatus using the flanges can also be curtailed.

The embodiments have described examples where the rotary member of the present invention is used as the developing roller in the developing device and in the image forming apparatus. However, a similar advantage can be yielded by use of the present invention in applications other than the developing roller, so long as the applications are directed toward a rotary member that rotates while being supported by bearings. Moreover, a similar advantage can also be yielded even when the rotary member of the present invention is used for an apparatus other than the developing device and the image forming apparatus.

According to an aspect of the present invention, there is provided a rotary member that is of inexpensive configuration, that exhibits superior abrasion resistance with respect to bearing members, and that has stable conductivity. Moreover, there is provided an inexpensive, highly-reliable developing device and an image forming apparatus which employ the rotary member as a developing roller.

What is claimed is:

1. A rotary member comprising:

a rotating main body; and support members, which are attached to ends of the rotating main body, and are formed to be supported by bearings, wherein each of the support members comprises:

a spindle core formed of a first metal; and a cylindrical sheath that sheathes a portion of the spindle core where slidably contacting respective one of the bearings and that is formed of a second metal different from the first metal, and wherein the cylindrical sheath includes an idling prevention portion contacting the spindle core and formed to prevent the cylindrical sheath from idling with respect to the spindle core, the idling prevention portion including an area in which the cylindrical sheath comprises a non-uniform inner diameter.

2. The rotary member according to claim 1, wherein the cylindrical sheath has Vickers hardness three times or greater than a Vickers hardness of the bearings.

3. The rotary member according to claim 1, wherein the second metal has Vickers hardness Hv equal to or greater than 150, and wherein the first metal has Vickers hardness Hv lower than 150.

4. The rotary member according to claim 1, wherein the second metal includes a stainless steel, and wherein the first metal includes an aluminum alloy.

5. The rotary member according to claim 1, wherein the support members comprise forged support members.

6. The rotary member according to claim 1, wherein the rotating main body includes a developing roller that is disposed opposite to a photosensitive element and that contacts the photosensitive element in a rotating state, thereby holding and supplying a toner to the photosensitive element.

7. A developing device comprising the rotary member according to claim 6.

8. An image forming apparatus comprising the developing device according to claim 7.

9. The rotary member according to claim 1, wherein the idling prevention portion includes a non-circular shape formed on an inner surface of the cylindrical sheath.

10. The rotary member according to claim 1, wherein the idling prevention portion includes a cutout on an end portion of the cylindrical sheath.

11. The rotary member according to claim 1, wherein an outer diameter of a portion of the spindle core abutting the cylindrical sheath is greater than an inner diameter of the cylindrical sheath.

12. The rotary member according to claim 1, wherein the idling prevention portion includes a toothed-shape formed on an inner surface of the cylindrical sheath.

13. The rotary member according to claim 1, wherein the rotating main body comprises a same metal as the first metal.

14. The rotary member according to claim 1, wherein a portion of the rotating main body which joins with the support members comprises a same metal as the first metal.

15. The rotary member according to claim 1, wherein the support members are inserted into the ends of the rotating main body.

16. The rotary member according to claim 1, wherein the spindle core is forged to be narrower than a certain thickness, wherein the cylindrical sheath is disposed on the narrowed spindle core, and wherein spindle core on which the cylindrical sheath is disposed is again forged.

17. The rotary member according to claim 1, wherein the spindle core includes a flange forged to be narrower than a certain thickness, wherein the cylindrical sheath includes a flange sleeve that is disposed on the narrowed flange, and wherein flange on which the flange sleeve is disposed is again forged.

* * * * *